United States Patent [19]

Menendez

[11] Patent Number: 4,958,464

[45] Date of Patent: Sep. 25, 1990

[54] LAPPING MACHINE

[76] Inventor: Alfredo S. Menendez, Calle Hermanos Machado, No. 18-1°, 24009 Leon, Spain

[21] Appl. No.: 367,869

[22] Filed: Jun. 19, 1989

[30] Foreign Application Priority Data

May 24, 1989 [ES] Spain ..... 8901765

[51] Int. Cl.[5] ..... B24B 19/00

[52] U.S. Cl. ..... 51/241 VS; 51/241 A

[58] Field of Search ..... 51/241 VS, 241 A, 241 B, 51/241 S

[56] References Cited

U.S. PATENT DOCUMENTS 2,338,509 1/1944 Hall et al. ..... 51/241 A

*Primary Examiner*—Frederick R. Schmidt
*Assistant Examiner*—Maurina Rachuba
*Attorney, Agent, or Firm*—Bucknam and Archer

[57] ABSTRACT

Lapping machine for lapping the security valve and pressure relief valve body seats installed in all kind of operations working with fluids under pressure, such as nuclear power plants, power stations, petrochemical plants, refineries, cellulose industries, etc., capable of performing a disc motion or to-and-fro movement on the valve seat, comprises a lapping disc which is easily adapted to the valve seat due to the action of its ball joint. It also maintains a constant pressure of the lapping disc on the seat. Due to its easy operation it may be installed on all security valves no matter how difficult the situation is.

1 Claim, 2 Drawing Sheets

LAPPING MACHINE

The invention of this lapping machine is, mainly, its design, a very easy one which, with no redundance of ancillary equipment, is capable of performing a more efficient disc motion or to-and-fro movement on the valve seat that the best machines known in the art may perform.

Figure 1:
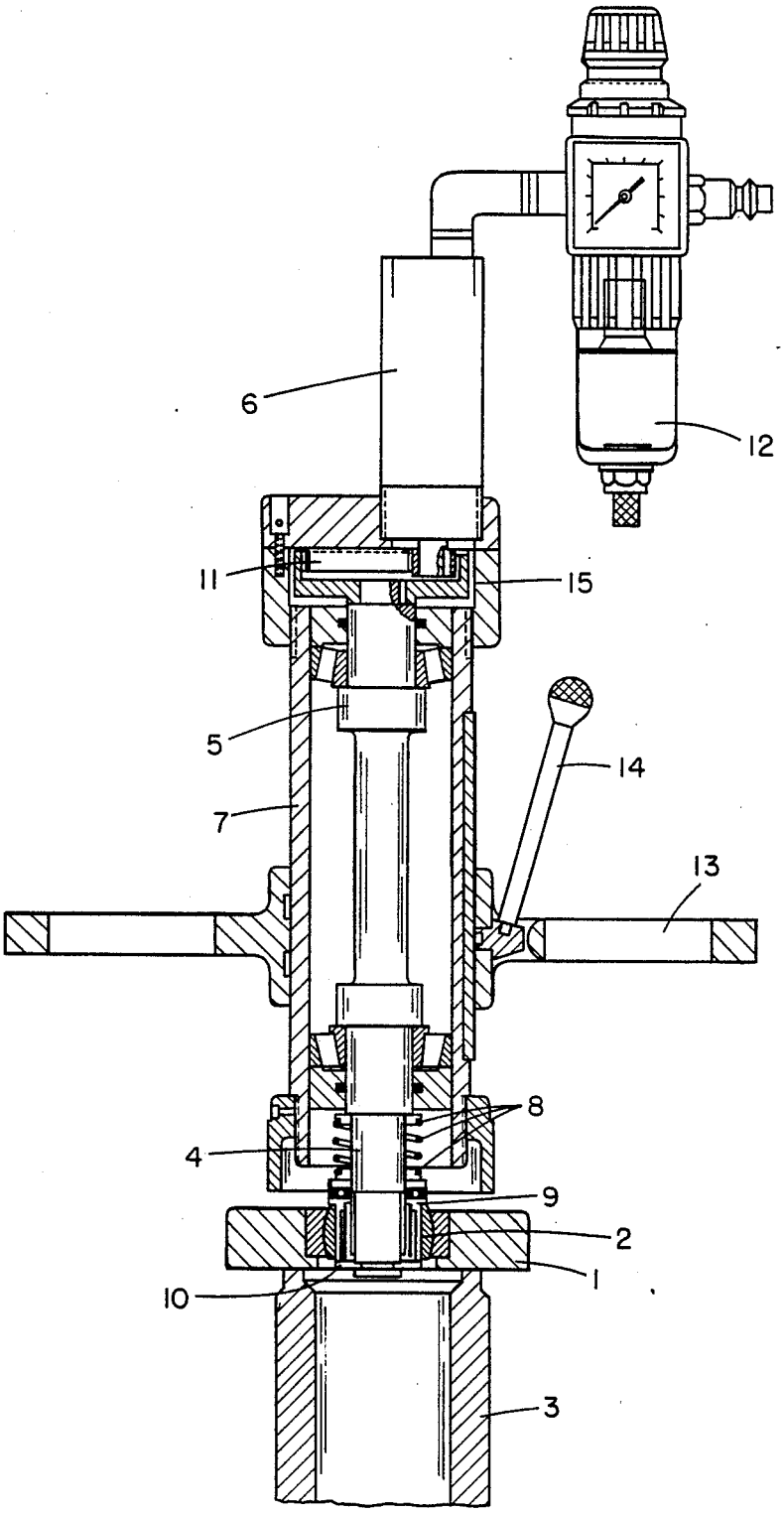

The disc to-and-fro motion is due to the part (4) in the machine axle (5) which is eccentrical in regard to the latter, as may be seen in the attached drawing, FIG. 1.

The most important specification in this invention consists of the easy way to adapt the lapping disc to the valve seat due to the action of its ball joint (2), as well as its ability to maintain a constant pressure of the lapping disc (1) on the seat (3) due to the spring (8).

There may obtain in this way optimum results in lapping the security valve and pressure relief valve seats never attained until this invention.

Due to its easy operation, ready installation and light weight, the LAPPING MACHINE may be installed in every security valve no matter how difficult the situation is, because lapping by hand is very hard at times and has a very high cost due to the time involved in this task.

Figure 2:
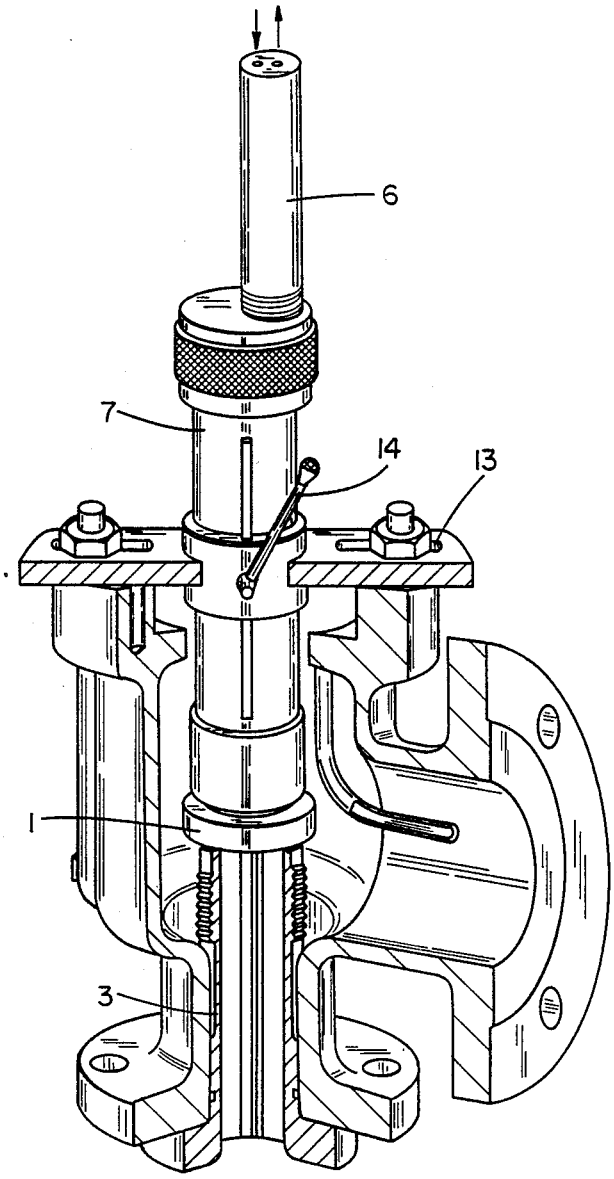

In order to make understanding of this invention's function, form and physical characteristics still easier, this present specification has attached a graphical representation of the LAPPING MACHINE, comprising a FIG. 1 which is an elevational view in cross-section. FIG. 2 illustrates the machine.

In this way, it may be seen how the lapping disc (1) leans its full surface on the tuyere seat (3) with a uniform strength imparted to it by pressure of the spring (8). The to-and-fro movement of the lapping disc is given by the eccentricity of part (4) in regard to the main axle (5). The machine also may perform an eccentric circular motion produced by part (4) of axle (5) and the friction between disc (1) and the seat of valve (3). The motion of the axle is caused by the crown gear (11) which in turn is driven by the pinion (15) pressed on the pneumatic motor shaft (6).

The LAPPING MACHINE assembly is attached to the valve body by means of the flange (13), and the lapping disc support (1) is adjusted by means of a lever

(14) which allows the machine to travel in an ascending and descending motion.

Due to the small effort required to drive the disc for its to-and-fro movement, the power of its motor is of only 0.45 HP and the pressure is 2 bars.

Everything described up to this point evidences the ease of this procedure as well as the economy it allows both with respect to the method, time, and the quality of the finished work in comparison with present manual methods, which many times force to service the security valves two or three times when performing the leakage tests provided for in the pressure containers regulations, since the number of leakage bubbles and the per minute leakage are surpassed.

Since leaning of the lapping disc (1) on the valve seat (3) is so perfect, no leakage has been detected in any of the valves lapped with the LAPPING MACHINE being the subject matter of his invention.

The materials, shape, size and disposition of the LAPPING MACHINE will be susceptible of modification, providing this does not imply any alteration of the invention essentials.

Terms used in the description of this specification should be taken in their widest sense, not limitative.

I claim:

1. A machine for lapping the body seat of a security valve or a pressure relief valve which comprises motor (6) in the upper part thereof, axle (5), a crown gear (11) and a pinion (15) connected to said motor and to said axle for driving said axle when the machine is in operation and the motor is actuated, a lapping disc (1) adapted to lap said valve seat (3) with uniform pressure, the lower part of said axle having part (4) eccentrically disposed thereto, a ball joint (2) positioned above said valve seat; a spring (8) positioned above said ball joint, said spring applying force upon said lapping disc when the machine is in operation to maintain contact between said lapping disc and said valve seat, said lapping disc being capable of frontward-backward motion and an eccentric circular motion, a tubular member (7) exterior to said axle positioned under said motor, a flange (13) for attachment to said body of said valve, a lever (14) connected to said flange, said lever connecting said tubular member to said flange, said frontward-backward motion being produced by said part (4) eccentric with respect to said axle, said eccentric circular motion being produced by friction between said lapping disc and said valve seat.

* * * * *